United States Patent [19]

Bryan

[11] 4,299,167

[45] Nov. 10, 1981

[54] NONELECTRIC DELAY INITIATOR

[75] Inventor: Paul J. Bryan, Hewitt, N.J.

[73] Assignee: E. I. Du Pont de Nemours & Co., Wilmington, Del.

[21] Appl. No.: 144,535

[22] Filed: Apr. 28, 1980

[51] Int. Cl.[3] ..... F42B 3/10

[52] U.S. Cl. ..... 102/202.3

[58] Field of Search ..... 102/27 R, 27 F

[56] References Cited

U.S. PATENT DOCUMENTS

| | | | |
|---|---|---|---|
| 2,652,775 | 9/1953 | Swanson . | |
| 3,106,892 | 10/1963 | Miller . | |
| 3,205,818 | 9/1965 | Coulson . | |
| 3,320,884 | 5/1967 | Kowalick et al. | 102/27 R |
| 3,709,149 | 1/1973 | Driscoll . | |
| 3,776,135 | 12/1973 | Zebree . | |
| 3,851,587 | 12/1974 | Alchorn et al. | 102/27 R |
| 4,232,606 | 11/1980 | Bryan . | |
| 4,248,152 | 2/1981 | Bryan . | |

*Primary Examiner*—Peter A. Nelson
*Attorney, Agent, or Firm*—D. C. Ascani

[57] ABSTRACT

A surface delay device which exhibits good precision in delay timing when it is ignited from the side output of a low-energy detonating cord (LEDC) trunkline and end-initiates an LEDC trunkline or downline has a percussion-sensitive ignition charge wedged between the integrally closed end of a metal shell and the end of a delay capsule, which houses the delay and priming charges. An orifice in the end of the delay capsule between the ignition and delay charges is kept free of the ignition charge, e.g., by providing an axial recess in the end of the shell extending at least as far as the orifice. In the field the end of a cord is fitted into a well which is seated in the main detonating charge, adapted to be initiated by the priming charge; and another cord is positioned transversely against the ignition end of the shell.

12 Claims, 4 Drawing Figures

NONELECTRIC DELAY INITIATOR

BACKGROUND OF THE INVENTION

1. Field of the Invention

The present invention relates to a nonelectric delay initiator for transmitting an explosion from a donor low-energy detonating cord to a receiver low-energy detonating cord, and to an assembly containing said initiator for the connection of said cords and initiation of the receiver cord.

2. Description of the Prior Art

The hazards associated with the use of electrical initiation systems for detonating explosive charges in mining operations, i.e., the hazards of premature initiation by stray or extraneous electricity from such sources as lightning, static, galvanic action, stray currents, radio transmitters, and transmission lines, are well-recognized. For this reason, nonelectric initiation through the use of a suitable detonating fuse or cord more and more has been capturing the interest of blasters.

Low-energy detonating cords, usually those having an explosive core loading of up to about 2 grams per meter of cord length, are very useful detonation-transmitting means for nonelectric detonation systems because they are characterized by low brisance and the production of little noise, and therefore can be used as trunklines in cases where noise has to be kept to a minimum, and as downlines in systems in which the cord must not be so brisant as to detonate the borehole charge or an adjacent section of cord. A "trunkline" is a common surface line of detonating cord from which multiple "downlines" of detonating cord depend and extend to explosive charges emplaced in various boreholes.

An improved low-energy detonating cord (LEDC) which is light-weight, flexible, and strong, detonates at high velocity, and is readily adapted to high-speed continuous manufacturing techniques is described in U.S. Pat. No. 4,232,606, issued Nov. 11, 1980, the disclosure of which is incorporated herein by reference. This cord can be initiated reliably by means of a coaxially abutted blasting cap, but not by the detonation of another length of detonating cord with which it is spliced or knotted. A field-connected explosive booster for propagating a detonation in connected detonating cord assemblies containing a cord such as that described in the aforementioned U.S. Pat. No. 4,232,606, e.g., an explosive starter for initiating a receiver low-energy detonating cord by means of a donor low-energy detonating cord, is described in co-pending U.S. Pat. No. 4,248,152, issued Feb. 3, 1981. One cord, usually the receiver, is inserted into an axial cavity of the booster in a manner such that an end-portion of the cord is surrounded by a granular explosive, and the other cord, usually the donor, is positioned transversely outside and adjacent to a closed end of the booster shell, preferably in a transverse slot in a tube which holds the booster. Detonation of the donor cord causes the instantaneous detonation of the receiver cord.

A nonelectric delay detonator adapted for field-assembly with a cord such as that described in the aforementioned U.S. Pat. No. 4,232,606 for the purpose of actuating the detonator is described in co-pending U.S. patent application Ser. No. 177,210, which is a continuation-in-part of Application Ser. No. 015,288, filed Feb. 26, 1979, now abandoned. The cord, e.g., a downline, is inserted into a deformable expansion shell, and the pressure pulse resulting from the detonation of the cord causes the shell to expand and an ignition charge around the expansion shell to be actuated as a result of sudden compression between the expansion shell and a rigid capsule. This results in the ignition of the delay and priming charges and detonation of the base charge.

In the art of nonelectric delay blasting there is need for a surface delay device adapted for field-assembly that will end-initiate a low-energy detonating cord (receiver cord), e.g., a trunkline or downline, from the side output of a low-energy detonating cord (donor cord), e.g., trunkline, transversely positioned outside a borehole, while providing a precise delay in the initiation of the receiver cord. The nonelectric delay detonator described in the aforementioned application Ser. No. 177,210 is adapted to be actuated by an axial cord (e.g., a downline cord) only, and thus is suited for use as an in-the-hole detonator to set off a blasting charge therein, directly or via a primer. The availability of a nonelectric delay initiator which could provide a precise delay between two trunklines, or between a trunkline and downline (as a delay starter) would provide the capability of delaying the firing of borehole charges at the surface as well as in the borehole.

Other nonelectric delay initiators are known which, like the detonator of U.S. application Ser. No. 015,288, are adapted to be actuated by percussive force applied thereto by an axial detonating cord. For example, U.S. Pat. No. 3,106,892 shows a delay initiator which is actuated by the end-output of a low-energy detonating cord. This initiator contains the usual ignition-to-detonation train in a tubular shell, i.e., starting at the closed end, first a base charge of detonating explosive, then, in sequence, a priming charge, a charge of exothermic-burning delay composition, and a capsule housing a percussion-sensitive ignition composition and a spacing member, the ignition composition being positioned between the closed end of the capsule and one end of the spacing member which forms an anvil head, and the air gap provided by the spacin member extending from the ignition composition to the delay composition. A booster charge of detonating explosive abuts the closed end of the capsule, and a length of low-energy detonating cord closes the open extremity of the shell with the cord end abutting the booster charge. The end output of the cord, after being "boosted" or intensified by the booster charge, applies the necessary percussive force to the ignition capsule.

Another delay detonator actuated by the percussion produced from a detonating cord adjacent a capsule containing a percussive-sensitive ignition composition is described in U.S. Pat. No. 3,709,149. In this detonator, as in the detonator described in U.S. Pat. No. 3,106,892, a spacing member provides an air gap between the percussion-sensitive ignition composition and the delay composition. Furthermore, in the detonator assembly shown in U.S. Pat. No. 3,709,149 any receiver detonating cord which may be present (e.g., downline 9 as a receiver cord with respect to detonator assembly 6') is positioned outside the detonator shell.

U.S. Pat. No. 3,776,135 also describes a cord-actuated delay detonator, the cord in this case being separated from the ignition charge by a perforation to allow venting of gases.

U.S. Pat. No. 3,205,818 does not describe a detonator, but it shows a connector for securing two detonating cords in perpendicular, operative relationship to one another. A capsule containing a booster charge of high-velocity detonating explosive is crimped to one end of a length of LEDC which abuts the booster charge. The bottom, closed end of the capsule is positioned adjacent to the side of a length of detonating fuse in a transverse slot in a tube which holds the capsule/LEDC assembly.

In summary, none of the cord-actuated delay initiators known to the art are adapted to be ignited from the side output of a transversely positioned cord to bring about the detonation of an axial cord. Although the detonator described in the aforementioned U.S. Pat. No. 3,709,149 is adapted to be ignited from the side output of a cord transversely positioned outside the detonator capsule, the ignition-to-detonation train progresses in the direction of the base of the detonator capsule, and no provision is made to affix an axial detonating cord thereto for the detonation thereof.

A detonator having an ignition-to-detonation train in a reversed direction is described in U.S. Pat. No. 2,652,775, but this detonator is not a delay detonator and no detonating cords are used therewith. The detonator, which is designed for firing a blasting charge in a well, comprises a tubular metal shell containing a thin layer of an impact-sensitive ignition charge pressed against a flat, thin closed end thereof, a metal anvil interposed between the ignition charge and an explosive priming charge, and a pressed main detonator charge adjacent to the priming charge. The anvil is either of slightly smaller diameter than the inside of the shell, or is provided with channels or perforations. A sealing plug closes the other end of the shell. To actuate this detonator, the ignition end of the shell is depressed by a firing pin moved by the impact of a dropping weight and a striker rod. The ignition charge is thereby squeezed between the shell and the anvil, and ignited. The resulting flash is transmitted to the priming charge, and the main charge detonates, thereby setting off a surrounding blasting charge.

SUMMARY OF THE INVENTION

The present invention provides a nonelectric delay initiator comprising a first tubular metal shell integrally closed at one end and containing, in sequence from the closed end:

(a) a percussion-sensitive ignition charge, e.g., a granular mixture of red lead, boron, and lead azide;

(b) a tubular metal capsule having one open extremity and a closure at the other extremity provided with an axial orifice therethrough, the capsule being nested within the first shell with its closed end innermost and seated against the ignition charge, substantially all of the ignition charge being wedged between the first shell and the capsule;

(c) a delay charge of an exothermic-burning composition, e.g., a boron/red lead mixture, within the capsule at the orifice-containing closed end thereof;

(d) a priming charge of a heat-sensitive detonating explosive composition, e.g., lead azide, within the capsule and adjacent to the delay charge;

(e) a second tubular metal shell integrally closed at one end and positioned coaxially within the first shell in a manner such as to produce an annular spacing around the second shell; and (f) a main charge of a detonating explosive composition, e.g., granular pentaerythritol tetranitrate (PETN), in the annular spacing and between the closed end of the second shell and the priming charge;

means being provided for sealing off the charges from the atmosphere and for preventing the venting of gases resulting from the burning of the ignition and delay charges, an open cavity extending from one end to the other of the second shell for receiving a low-energy detonating cord adapted to be detonated by the pressure pulse applied thereto by the detonation of the main charge adjacent to the second shell, and the cavity being provided with a cord-retention means for holding the cord coaxially therein.

As will be explained more fully later, better precision in delay timing results when the ignition charge in the initiator is present essentially only between the capsule and shell surfaces, i.e., substantially absent from the orifice in the delay capsule. During loading, any part of the ignition charge that collects in the orifice can be removed prior to the loading of the delay charge. Moreover, in a preferred embodiment, the closed end of the first tubular metal shell is provided with an axial recess which extends at least as far as the axial orifice in the capsule. This recess forms an axial convex inner surface on the end of the shell which prevents the ignition charge from being deposited in the orifice and causes it to adopt an annular configuration.

BRIEF DESCRIPTION OF THE DRAWING

In the accompanying drawing, which illustrates specific embodiments of the delay initiator of the invention and its use.

DETAILED DESCRIPTION

Figure 1:
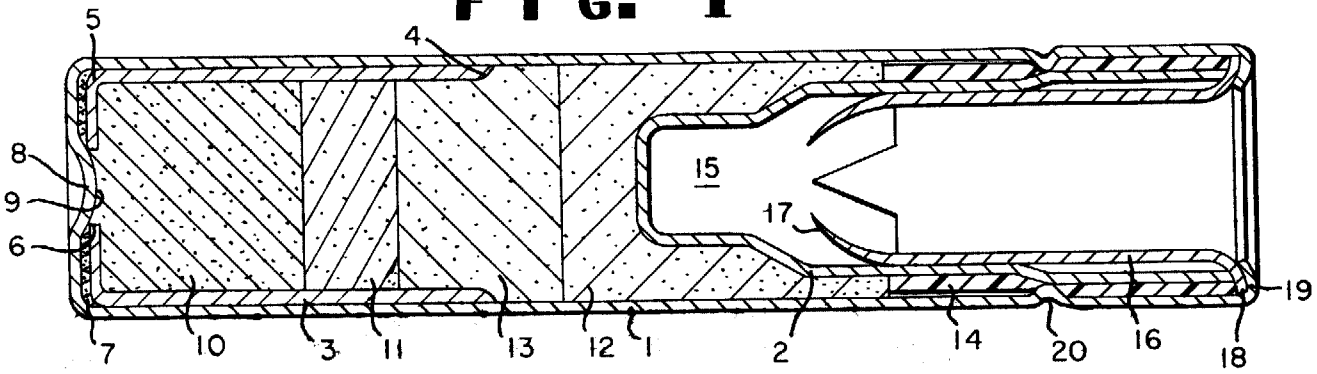
FIG. 1 is a longitudinal cross-section of a delay initiator of the invention.

In the initiator depicted in FIG. 1, 1 is a first tubular metal shell, i.e., the outer shell of the initiator; and 2 is a second tubular metal shell positioned coaxially within shell 1. Both shell 1 and shell 2 are closed at one end and open at the opposite end, shell 2 being seated within shell 1 with its closed end the innermost end and in a manner such that an annulus separates the sidewalls of the two shells.

Tubular metal capsule 3 is nested within shell 1. This capsule has one open extremity 4 and a closed extremity 5 provided with an axial orifice 6. Capsule 3 holds a delay charge 10 of an exothermic-burning composition, which is also present in orifice 6. Closed extremity 5 of capsule 3 is seated against adjacent percussion-sensitive ignition charge 7, orifice 6 being coaxial with an axial recess 8 in the closed end of shell 1, and recess 8 extending into orifice 6. Convex inner surface 9 is a means of keeping ignition powder 7 from collecting in orifice 6 during the loading of the charges into shell 1.

Capsule 3, which is a carrier for delay charge 10, also carries the priming charge 11 of heat-sensitive detonating explosive. This feature also assures better precision in timing owing, it is believed, to the inaccessibility of the priming charge to the gases evolved when ignition charge 7 burns. The main or output charge 12, 13 of detonating explosive composition has a pressed portion 13 adjacent to priming charge 11 and a loose-load portion 12 surrounding the closed end portion of shell 2.

A deformable grommet or sleeve 14, e.g., one made of rubber or a plastic such as polyethylene, fits around shell 2 near the outer, open end thereof. A convenient way of making the initiator is to load the charges and capsule into shell 1, and then to seat shell 2, with grommet 14 mounted thereon, within shell 1 while displacing some of charge 12 up into the spacing between the shells' walls. Grommet 14 is of such a length as to extend into the space between the walls about as far as charge 12.

One of the functions of inner shell 2 is to provide a means of sealing the charges from the atmosphere, a feature which is essential if the initiator is to have a field-assembly capability. Another function of shell 2 is associated with the open cavity 15 therein that extends from one end of shell 2 to the other. This cavity acts as a well for the proper axial positioning therein of a detonating cord which is to be initiated by the pressure pulse applied thereto by the detonation of main charge 12. Located in cavity 15 is a cord-retention means in the form of an open-ended metal sleeve 16 that frictionally engages the inside wall of shell 2 and has cord-gripping means 17, i.e., a number of inwardly directed prongs, formed on its inner end. While a cord can be inserted into cavity 15 through prong-ended sleeve 16, the prongs prevent the motion of the cord in the opposite direction when tension is applied thereto.

The outer end of metal sleeve 16 is provided with a lip portion 18 that extends over the outer ends of shell 2 and grommet 14. Crimp 19 locks shell 2 in place, keeping it from becoming dislodged by the internal pressure produced when charge 7 ignites. Grommet 14 and circumferential crimp 20 in the side of shell 1 seal charges 7, 10, 11, 13, and 12 off from the atmosphere.

The initiator is a self-contained, sealed unit and can be stored, transported, and otherwise handled as required separated from the detonating cords with which it is designed to be used. At the time of use, the initiator can be assembled together with the cords using any suitable connection means. However, a preferred means for retaining the cords and initiator in their required positions for effecting the propagation of a detonation from a trunkline to another trunkline or to a downline is a connector of the type described in U.S. Pat. No. 3,204,818 and in the aforementioned U.S. Pat. No. 4,248,152, the disclosures of which are incorporated herein by reference.

Figure 2:
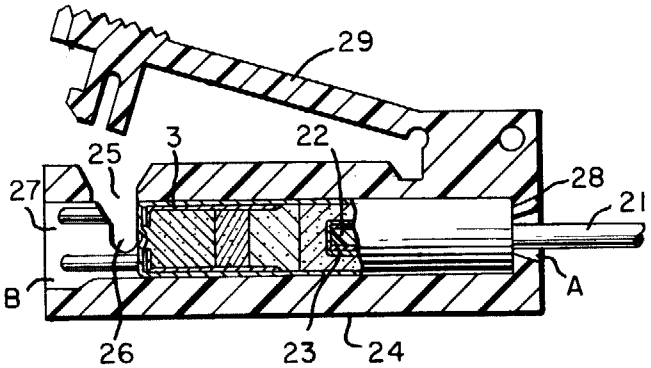
FIG. 2 is a view in partial cross-section of an initiator-connector assembly containing the delay initiator shown in FIG. 1.

Referring to the initiator shown in FIG. 1 and the initiator-connector assembly shown in FIG. 2, an end-portion of a length of low-energy detonating cord trunkline or downline 21 is located in cavity 15 and has its end seated against the closed end of shell 2. Prongs 17 grip cord 21 and thus prevent it from being pulled out of cavity 15. Cord 21 consists of a continuous solid core 22 of a deformable bonded detonating explosive composition, e.g., superfine PETN admixed with a binding agent such as plasticized nitrocellulose; core-reinforcement means (not shown) consisting of a mass of filaments derived from multi-filament yarns in contact with the periphery of core 22 parallel to the core's longitudinal axis; and a protective plastic sheath 23, which encloses core 22 and the core-reinforcing filaments. Cords of this type are described in the aforementioned U.S. Pat. No. 4,232,606. The explosive loading in the core of this cord preferably is about from 0.2 to 2 grams per meter of length.

The connector shown in FIG. 2 comprises a tube 24 of preferably electrically nonconductive material, e.g., a plastic material, having open extremities A and B and a transverse slot 25 near extremity B and communicating with the bore 27 of the tube. Slot 25 has a recessed channel 26 which is adapted to engage a trunkline perpendicular to the longitudinal axis of tube 24. The initiator is seated in the bore 27 of the tube with the closed end of shell 1 adjacent to slot 25 and the other end of shell 1 resting against shoulder projection 28, which prevents the initiator from being pulled out of tube 24 when a force is exerted on cord 21. It is feasible to first insert the initiator into tube 24 through extremity B until it becomes seated against projection 28 (e.g., at the time of use, or at the place of manufacture or elsewhere prior to the time of use), and thereafter to insert cord 21 into cavity 15 until the end of cord 21 becomes seated against the closed end of shell 2. Likewise, cord 21 can be positioned in cavity 15 first, and thereafter the initiator-cord assembly threaded through tube 24 from extremity B until the initiator becomes seated against projection 28 while cord 21 emerges from extremity A. Tube 24 has slotted locking means 29 adapted to form a closure with slot 25 to lock the trunkline in place.

Figure 3:
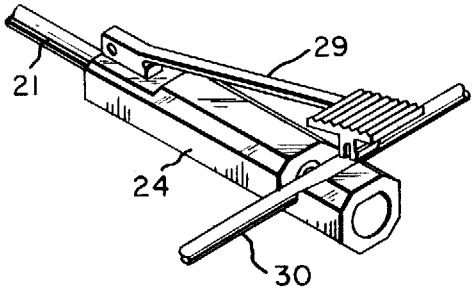
FIG. 3 is a perspective view of a detonating cord assembly containing the initiator-connector assembly shown in FIG. 2.

FIG. 3 shows a length of low-energy detonating cord trunkline 30, e.g., a cord having the same structure as cord 21 and a core explosive loading in the same range, positioned in recessed channel 26 in a manner such that a side-portion of the trunkline is adjacent to the closed end of shell 1.

The use of the initiator and cord assembly of the invention will now be described by way of examples.

EXAMPLE 1

The initiator shown in FIG. 1 was made as follows: Shell 1 was a standard detonator shell, e.g., a shell made of Type 5052 aluminum alloy, 33 mm long and having an outer diameter of 7.1 mm and an internal diameter of 6.6 mm. Its bottom, which was 0.9 mm thick, had an axial recess 1.0 mm deep. Shell 2 also was made of Type 5052 aluminum alloy, and had a wall and bottom thickness of 0.3 mm. The length of shell 2 was 3.3 mm in its smallest-internal-diameter section of 2.9 mm, and 5.1 mm in its largest-internal-diameter section of 5.0 mm. Its overall length was 16.5 mm. The upper taper in the wall of shell 2 was 30° off, and the lower taper 60° off, the longitudinal axis.

Ignition charge 7, which consisted of 0.5 gram of a 1.7/98.3/10 (by weight) boron/red lead/dextrinated lead azide mixture, was loosely loaded into shell 1, after which bronze capsule 3 was pressed into the shell at 1335 Newtons until its extremity 5 was essentially in contact with the convex surface of recess 8. The thickness of ignition charge 7 was about 0.5 mm. After the placement of capsule 3, shell 1 was overturned and shaken to remove any grains of ignition charge 7 that may have been lodged in orifice 6.

Capsule 3 was 11.1 mm long, and had an outer diameter of 6.5 mm and an inner diameter of 5.7 mm. Axial orifice 6 was 2.0 mm in diameter. Delay charge 10, which was pressed into capsule 3 at 1335 Newtons, was a 2.5/97.5/20 mixture (by weight) of boron, red lead, and silicon, grained with polysulfide rubber, the weight of charge 10 (and therefore its length) varying depending on the delay period to be provided. Priming charge 11 was 0.2 gram of dextrinated lead azide, which had been loaded into capsule 3 and pressed therein at 1335 Newtons. Portion 13 of the main charge was 0.33 g of PETN pressed into capsule 3 and shell 1 at 1335 Newtons. Portion 12 was 0.23 g of loose-loaded PETN.

Grommet 14, made of low-density polyethylene and having a length of 9.0 mm, an outer diameter of 6.4 mm, and an inside diameter of 5.4 mm, was fitted onto shell 2 in a manner such that the edge surfaces of shell 2 and grommet 14 at the outer end were substantially coplanar. Bronze sleeve 16 had an overall length of 12 mm, an outer diameter of 4.5 mm, an inner diameter of 4 mm, and a 2.5-mm tapered portion having four cord-gripping prongs 17, which reduced the diameter of the sleeve at the gripping end to 2 mm. Sleeve 16 was fitted into shell 2 in a manner such that lip portion 18 rested over the ends of shell 2 and grommet 14. The assembly of shell 2, grommet 14, and sleeve 16 was pressed into shell 1 at 667 Newtons, thereby compacting charge 12 and displacing some of it into the annular space between the facing walls of shells 1 and 2.

The initiator was positioned in the cord connector shown in FIG. 2 as follows:

Trunkline cord 21 had an outer diameter of 2.5 mm, a 1.3-mm-diameter core (22), and an 0.6-mm-thick low-density polyethylene sheath (23). The core 22 consisted of a mixture of 75% superfine PETN, 21% acetyl tributyl citrate, and 4% nitrocellulose prepared by the procedure described in U.S. Pat. No. 2,992,087. The superfine PETN had an average particle size less than 15 microns, with all particles smaller than 44 microns. The core-reinforcing filaments were derived from eight 1000-denier strands of polyethylene terephthalate yarn substantially uniformly distributed on the periphery of core 22. The PETN loading in core 22 was 1.49 grams per meter.

One end of a length of trunkline cord 21 was inserted into cavity 15 of shell 2 of the initiator until it became seated against the closed end of shell 2. Prongs 17 gripped trunkline cord 21 and prevented it from being retracted from shell 2. The initiator had previously been positioned in tube 24 until it had become seated against projection 28 as shown in FIG. 2. Tube 24 was made of low-density polyethylene.

A length of trunkline cord 30 (the same as core 21) was positioned in recess channel 26 of slot 25 of connector tube 24 whereby the closed end of shell 1 of the initiator was butted against the side of trunkline cord 30. Slotted locking means 29 was pushed into slot 25 and snapped into place, thereby locking trunkline cord 30 into its transverse position.

Trunkline 30 was detonated by means of a No. 6 blasting cap having its end in coaxial abutment with the exposed end of the cord. The detonation was transmitted from trunkline 30 to the initiator (surface delay), and from the initiator to trunkline 21.

The above-described initiator was made in different delay periods, each having a different weight (and length) of delay charge. The initiators were tested for delay time in the cord assembly described above. The results were as follows:

| Delay Charge | | Measured Delay Time, ms. | | |
|---|---|---|---|---|
| Wt., g. | Length mm. | Mean* | Standard Deviation | Range |
| 0.18 | 2.0 | 10.8 | 1.0 | 3.9 |
| 0.18 | 2.0 | 11.2 | 0.4 | 1.3 |
| 0.23 | 2.54 | 14.1 | 0.7 | 2.2 |
| 0.35 | 3.78 | 21.2 | 0.4 | 1.5 |

*Based on 15 initiators tested

EXAMPLE 2

Figure 4:
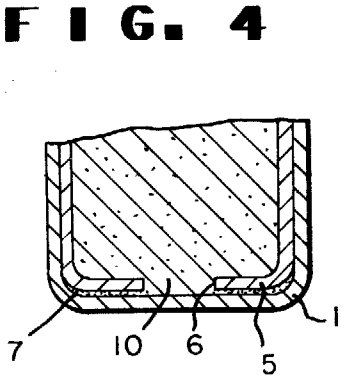
FIG. 4 is a partial cross-section of the FIG. 1 initiator having an alternative design of its ignition end.

The same initiator described in Example 1 was made except that the closed end of shell 1 was substantially flat (i.e., there was no recess therein), as depicted in FIG. 4. After capsule 3 had been pressed into place, grains of ignition charge 7 present in orifice 6 were dislodged by overturning and shaking the assembly. Delay charge 10 entered orifice 6 as a result of being pressed into capsule 3. In this configuration the delay charge 10 was initiated essentially circumferentially by the thin layer of ignition charge wedged between shell 1 and capsule 3. The delay timing of this initiator was tested as described in Example 1.

| Delay Charge | | Measured Delay Time, ms. | | |
|---|---|---|---|---|
| Wt., g. | Length mm. | Mean* | Standard Deviation | Range |
| 0.25 | 2.72 | 15.9 | 1.4 | 2.8 |
| 0.28 | 3.00 | 17.6 | 0.8 | 2.6 |
| 0.30 | 3.25 | 19.8 | 1.1 | 2.8 |
| 0.35 | 3.78 | 20.2 | 1.5 | 3.6 |
| 0.40 | 4.32 | 24.0 | 0.5 | 1.8 |
| 0.45 | 4.85 | 26.5 | 0.4 | 0.8 |
| 0.50 | 5.38 | 28.0 | 0.9 | 2.2 |
| 0.52 | 5.59 | 44.8 | 12.6 | 31.5 |
| 0.35[a] | 3.78 | 29.8 | 0.8 | 2.6 |
| 0.38[b] | 4.11 | 39.4 | 1.9 | 6.5 |
| 0.35[c] | 3.78 | 59.0 | 1.4 | 3.9 |

*Based on 10 initiators tested
[a]Delay charge: 2.5/97.5 boron/red lead
[b]Delay charge: 2.0/98 boron/red lead
[c]Delay charge: 1.5/98.5 boron/red lead

EXAMPLE 3

The initiator shown in FIG. 1 with the end-modification shown in FIG. 4 was tested for delay timing and compared with the same initiator in which the grains of ignition charge 7 had not been removed from orifice 6. The ignition charge was 0.045 g of 1.7/98.3/10 boron-red lead-dextrinated lead azide, and the delay charge was 0.25 g of the composition used in Example 1. The results were as follows:

| Powder Removed from Orifice | Measured Delay Time, ms. | | |
|---|---|---|---|
| | Mean* | Standard Deviation | Range |
| Yes | 16.1 | 1.1 | 3.0 |
| No | 12.1 | 2.3 | 7.7 |

*Based on 10 initiators tested

An important prerequisite to successful delay blasting is that the delay times of a number of initiators of stated delay rating be as uniform as possible from initiator to initiator. Without good uniformity, it is difficult to achieve a desired rock fragmentation, vibration reduction, etc. as expected from a given delay pattern. The foregoing examples show that the delay initiator of the invention exhibits good uniformity and predictability of delay time, and that this uniformity is related to the sharp interface or separation between the ignition and delay charges achieved by the absence of the ignition charge in the orifice in the delay capsule.

Precision of delay timing also is dependent on controlling the size of the ignition and delay charges. Keeping the ignition charge to a minimum, e.g., about from 0.2 to 0.6 mm thick, permits a smooth ignition of the delay charge, thereby avoiding variations in timing caused by disturbance of the delay column. The composition selected to be used as the ignition charge is one which is ignitible by percussion, i.e., by the sudden impact of the bottom of the initiator shell from the detonation of the cord transversely adjacent thereto; reliably propagates the initiation stimulus from the detonating cord to the delay charge 10; and is substantially gasless when it decomposes, to prevent rupturing of the surrounding shell. Preferred ignition compositions consist essentially, by weight, of at least about 80% red lead (lead tetroxide), about from 1 to 5.0% boron, and up to about 15% lead azide, lead styphnate, or a mixture thereof. Certain of these compositions are described in U.S. Pat. No. 3,306,201, the disclosure of which is incorporated herein by reference. More-sensitive ignition compositions may be required in initiators to be used with detonating cords having smaller core loadings than in those used with cords having larger loadings. Generally, about a 0.02 to 0.06 gram ignition charge gives best results and is preferred.

The exothermic-burning composition used as the delay charge can be any of the gasless exothermic-reacting mixtures of solid oxidizing and reducing agents that burn at a constant rate and that are commonly used in ventless delay detonators. Examples of such mixtures are boron-red lead, boron-red lead-dibasic lead phosphite, boron-red lead-silicon, silicon-red lead, aluminum-cupric oxide, magnesium-barium peroxide-selenium, etc. The charge should be pressed into the delay capsule with a force of at least about 890 Newtons. The range of delay charge weights over which good precision is attained varies with different compositions. For example, as can be seen from Example 2, with boron-red lead compositions good precision is achieved in a delay load range of about from 0.30 to 0.40 gram; while a wider range, i.e., about from 0.25 to 0.50 gram, is operable with boron-red lead-silicon compositions.

The priming charge can be any heat-sensitive detonating explosive composition which is readily initiated by the burning of the delay composition, e.g., lead azide, mercury fulminate, diazodinitrophenol, or a similar composition.

The composition used for the main charge can be any of the charges conventionally used as base charges in detonators, e.g., PETN, cyclotrimethylenetrinitramine, cyclotetramethylenetetranitramine, lead azide, picryl sulfone, nitromannite, TNT, and the like.

While the present initiator can be adapted to transmit an explosion from any low-energy detonating cord to another in the manner described herein, it is especially adapted to be actuated from the side output of detonating cord having an explosive loading of about from 0.2 to 2 grams per meter, and to end initiate a cord having an explosive loading of about from 0.2 to 2 grams per meter.

I claim:

1. A nonelectric delay initiator comprising a first tubular metal shell integrally closed at one end and containing, in sequence from the closed end:

(a) a percussion-sensitive ignition charge;

(b) a tubular metal capsule having one open extremity and a closure at the other extremity provided with an axial orifice therethrough, said capsule being nested within said first shell with its closed end innermost and seated against said ignition charge, substantially all of said ignition charge being wedged between said first shell and said capsule;

(c) a delay charge of an exothermic-burning composition within said capsule at the orifice-containing closed end thereof;

(d) a priming charge of a heat-sensitive detonating explosive composition within said capsule and adjacent to said delay charge;

(e) a second tubular metal shell integrally closed at one end and positioned coaxially within said first shell in a manner such as to produce an annular spacing around said second shell; and (f) a main charge of a detonating explosive composition in said annular spacing and between the closed end of said second shell and said priming charge;

means being provided for sealing off said charges from the atmosphere and for preventing the venting of gases resulting from the burning of said ignition and delay charges, an open cavity extending from one end to the other of said second shell for receiving a low-energy detonating cord adapted to be detonated by the pressure pulse applied thereto by the detonation of the main charge adjacent to said second shell, and said cavity being provided with a cord-retention means for holding said cord coaxially therein.

2. The initiator of claim 1 wherein the closed end of said first tubular metal shell has an axial recess which extends at least as far as the axial orifice in said tubular metal capsule.

3. The initiator of claim 2 wherein said recess extends into said orifice, any remaining space in said orifice being filled with said delay charge.

4. The initiator of claim 1 wherein the closed end of said first tubular metal shell is substantially flat, and said delay charge fills said orifice.

5. The initiator of claim 1 wherein said second tubular metal shell has a smaller diameter at its integrally closed end than at its opposite end.

6. The initiator of claim 1 wherein said cord-retention means is an open-ended sleeve having cord-gripping means associated therewith, said sleeve frictionally engaging the inside wall of said second shell and extending from the open end of said second shell toward the integrally closed end thereof.

7. The initiator of claim 6 wherein said cord-gripping means consists of at least one inwardly directed prong formed on the inner end of said sleeve.

8. The initiator of claim 6 wherein a deformable grommet is sandwiched between said first and second shells starting from their open ends, said shells and grommet being held together by one or more circumferential side crimps.

9. The initiator of claim 6 wherein said sleeve is made of metal and, at its outer end, is provided with a lip portion that extends over the end of said second shell or over a conforming lip portion on the end of said second shell.

10. The initiator of claim 1 wherein said ignition charge is a pressed granular mixture consisting essentially, by weight, of at least about 80% red lead; about from 1.0 to 5.0% boron; and up to about 15% lead azide, lead styphnate, or a mixture thereof.

11. An initiator-connector assembly comprising the delay initiator of claim 1 snugly seated in the bore of a tube having two open ends and a transverse slot communicating with said bore, said initiator being positioned with the closed end of said first shell thereof adjacent to said slot, said slot being adapted to engage a detonating cord in a recessed position in said tube substantially perpendicular to the tube's longitudinal axis, said tube having locking means adjacent to said transverse slot for preventing the disengagement of said perpendicular cord therefrom and stop means adjacent one end to prevent the initiator from being pulled out of said tube when a force is exerted on a detonating cord positioned in the cavity of the initiator's second shell.

12. A detonating cord assembly comprising the initiator of claim 1, a low-energy detonating cord trunkline adjacent to the closed end of said first metal shell perpendicular to said shell's longitudinal axis, and a low-energy detonating cord trunkline or downline within the cavity of said second shell.

* * * * *